United States Patent [19]

Grant

[11] 4,293,155

[45] Oct. 6, 1981

[54] LOG HANDLING AND TRANSPORT SYSTEM

[75] Inventor: Peter S. Grant, Federal Way, Wash.

[73] Assignee: Weyerhaeuser Company, Tacoma, Wash.

[21] Appl. No.: 95,859

[22] Filed: Nov. 19, 1979

[51] Int. Cl.[3] ..... B66C 1/12

[52] U.S. Cl. ..... 294/75

[58] Field of Search ..... 294/67 E, 67 EA, 74–76, 294/78 R, 81 R, 83 R; 414/140, 293, 342, 348, 393, 399, 608

[56] References Cited

U.S. PATENT DOCUMENTS

| | | | |
|---|---|---|---|
| 426,308 | 4/1890 | Palm | 294/74 X |
| 2,622,540 | 12/1952 | Stewart et al. | 294/74 X |
| 3,079,193 | 2/1963 | Brewer | 294/75 |
| 4,073,531 | 2/1978 | Androski | 294/75 X |

FOREIGN PATENT DOCUMENTS

| | | | |
|---|---|---|---|
| 40161 | 1/1937 | Netherlands | 294/74 |
| 165301 | 11/1958 | Sweden | 294/74 |
| 207077 | 9/1966 | Sweden | 294/75 |
| 265549 | 10/1927 | United Kingdom | 294/74 |
| 533584 | 2/1941 | United Kingdom | 294/74 |
| 556100 | 5/1977 | U.S.S.R. | 294/74 |

*Primary Examiner*—Johnny D. Cherry

[57] ABSTRACT

A grouping of elongated objects such as logs are supported in a pair of elongated wire slings that are releasably attached to an overhead frame. When loading logs onto ships, the overhead frame is attached to the ship's gear for use. For loading, the frame is lowered and a load of logs is surrounded at spaced apart locations with the wire slings. At each end of a wire sling is an eye which is secured within a releasable hook mounted in pairs on the frame. A sliding snap hook fixed to one eye of each sling is hooked to the opposite eye so as to form a continuous sling about the logs. The load is then lifted into the ship and placed after which the releasable hooks release the continuous wire slings allowing the load of logs to conform to the volume where it is placed. The slings remain in place about the logs during the voyage.

11 Claims, 7 Drawing Figures

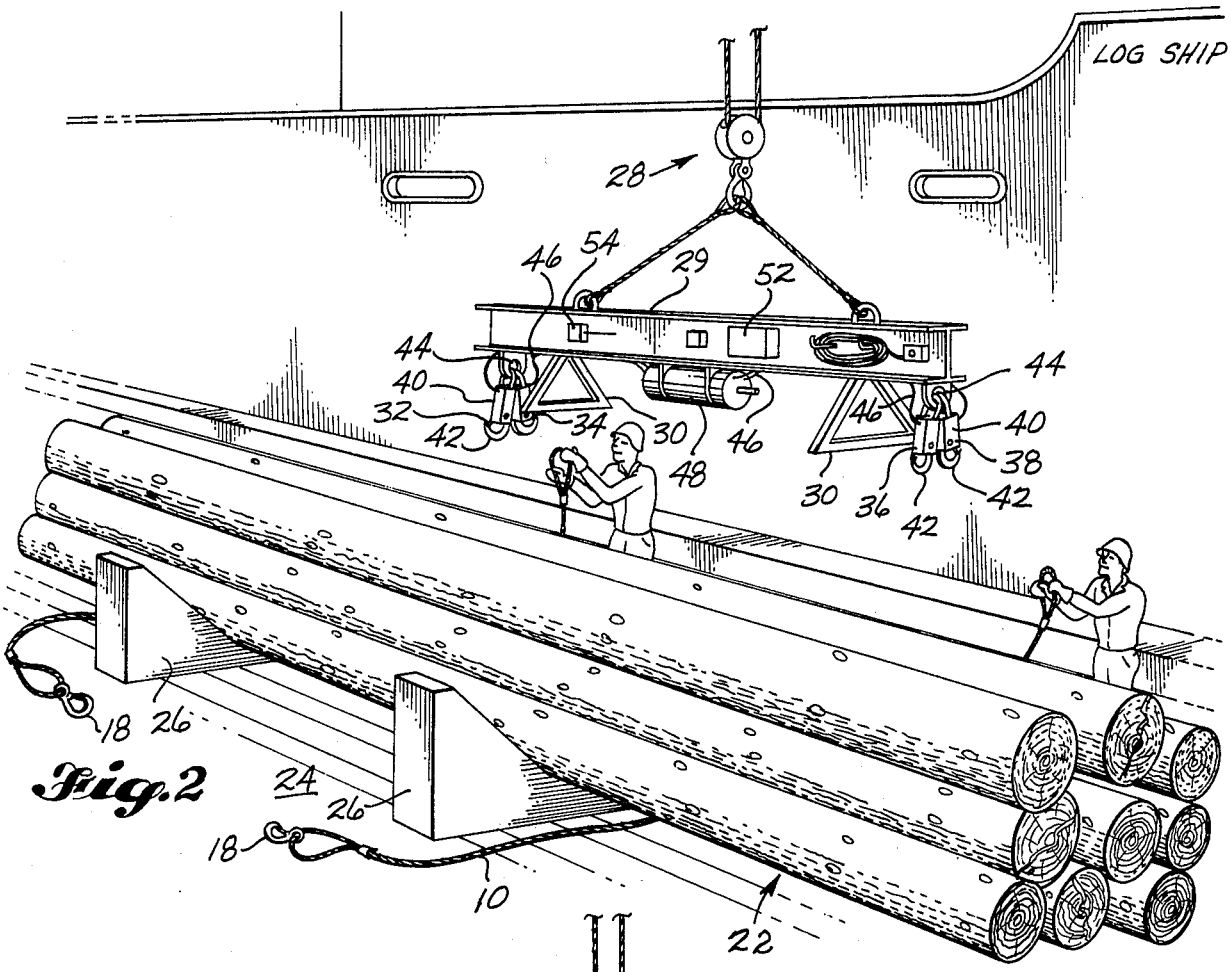
Fig. 2
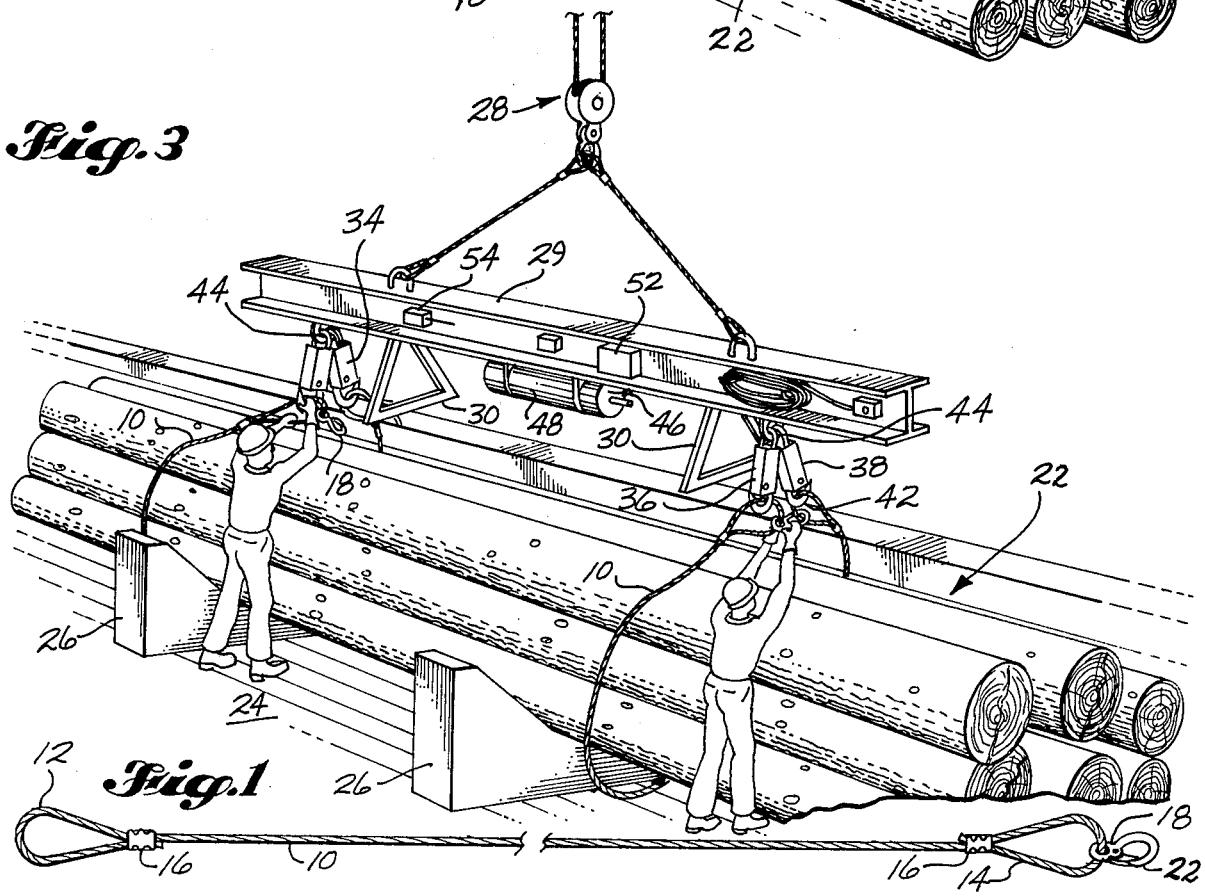
Fig. 3
Fig. 1

LOG HANDLING AND TRANSPORT SYSTEM

BACKGROUND OF THE INVENTION

This invention relates generally to handling and transporting elongated objects such as logs and more particularly to a handling system whereby elongated objects can be loaded into and discharged from a suitable transport means for shipment or the like.

With the development of the export log business from the West Coast of the United States to foreign countries, particularly to Japan, various handling and transport systems have been developed for loading and unloading logs into typical log ships. A currently used method includes, for example, the placing of logs in a bunk at the load side of a ship and the placement of wire slings around logs and attachment at the ends of the slings to a single point to the ship's gear. The ship's gear then is activated to lift the loose load of logs and move them to the proper position. One method requires, once the logs are in position aboard the ship, that workers then physically release the wire slings from the load of logs to retrieve them. As one might expect, this procedure is extremely dangerous and also is time consuming in that the cycle time for loading and unloading a ship is increased.

Another method that is somewhat safer although still time consuming and additionally has the problem of space utilization within the ship is where bundles of logs are unitized in a rigid manner with steel bands. Banded groups of logs are placed within a bunk and then loaded aboard ship in the usual way; however, when the slings are released by the workers, the logs will not freely conform to the available space and as additional bundles are loaded, voids will form thereby resulting in unused space. In addition, while this system is somewhat safer than the first described system, men are still required to be in the hold to physically release and retrieve the slings.

At the discharge side of the voyage, even more time is required than at loading since again individual workers will be required to physically attach the wire slings to an appropriate grouping of logs before they can be removed from the ship. Again, this is an extremely dangerous operation and is quite time consuming. Logs have been known to roll and also slip from their bundles during handling. When any prior method was used, the slings were always retrieved prior to beginning the voyage and then reattached at the discharge end for unloading.

Accordingly, from the foregoing, one object of the present invention is to provide a log handling and transport system for loading, shipping, and unloading logs that reduces the need for manpower in dangerous areas.

Another object of the present invention is to reduce the loading and unloading time for logs thereby reducing the time that the ship or transport means is required.

Yet a further object of this invention is to provide flexibility in the handling system for either dock or water discharge of the logs.

Yet an additional object of this invention is to provide a flexible unitization of logs when on board so as to allow the logs to conform to the available space.

These and many other objects of the present invention will be better and more completely understood by reading the specification to follow in conjunction with the attached drawings.

SUMMARY OF THE INVENTION

Briefly stated the present invention is practiced in one form by an elongated object handling and transporting system where a plurality of elongated objects such as logs are flexibly unitized for transporting by a pair of spaced apart slings each of which has an eye in both ends. For loading and transport, a slidable snap hook in one eye of each sling is releasably attached to the opposite eye to form the flexible continuous sling. At the loading side, for example when loading logs onto a ship, the ship's gear lowers an overhead frame to a position above a load of logs within a bunk and the pair of slings is secured about the logs. On the elongated frame are two pairs of swively mounted releasable hook means into which each eye on each end of a pair of slings will be positioned for loading and unloading. To load, the ship's gear then lifts the frame with the depending bundle of logs supported within the slings to the storing position within the ship at which point the releasable hooks will be activated to release the logs with the continuous slings still in place. Within the hold of a ship, for example, since the logs are loosely held within the slings, the bundle will conform to the available space.

At the discharge site, the snap hook will be released from the opposed eye and both eyes will again be attached to the releasable hooks on the frame. The frame and logs will then be lifted by the ship's gear to a position alongside the ship where the logs can be discharged either into a bunk on the dock or into the water. If the logs are discharged into a bunk, the releasable hooks are simply opened to release the eyes of the slings, but if the logs are to be discharged into the water, at least one eye of each sling will be secured through suitable means to the frame so that they may be retrieved. If logs are to be accumulated on the dock, then one eye of each sling must be similarly attached for sling retrieval.

BRIEF DESCRIPTION OF THE DRAWINGS

FIG. 1 is a view showing an individual sling with eyes at either end and a slidable snap hook on one eye.

FIG. 2 is a perspective view showing the present invention being used at the loading dock of a log ship.

FIG. 3 is a view similar to FIG. 2 showing the workers connecting the slidable snap hook to the opposed eye with the frame supporting the slings.

DESCRIPTION OF THE PREFERRED EMBODIMENT

Figure 4:
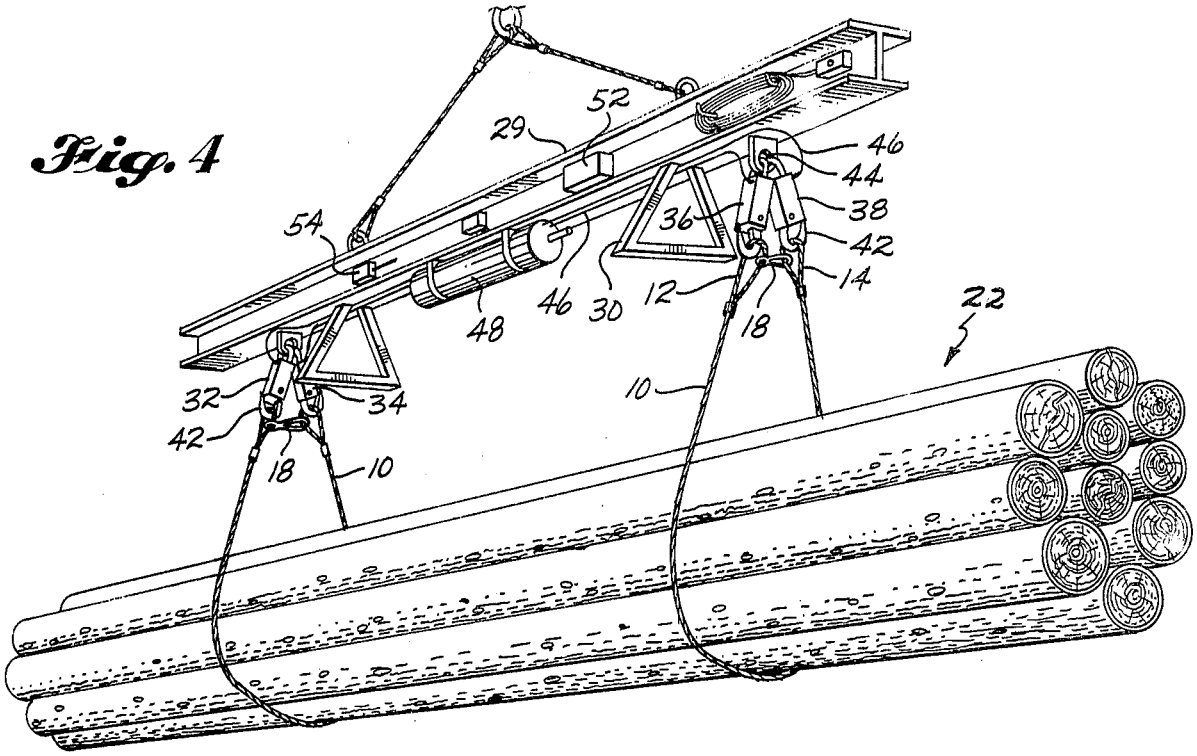
FIG. 4 is also a perspective view showing the elongated frame lifting a bundle of logs.

Turning first to FIGS. 1–3, the structural features of the present invention will be described. In FIG. 1 there is depicted in elongated form a single wire sling 10. At either end of sling 10 is an eye 12, 14 respectively, which are held in place through swedgings 16. Slidably attached to one eye is the snap hook 18. The hook mechanism 20 of the snap ring is sized so that it may be snapped onto the other eye for forming a unitary sling as will be further explained later. While slings 10 are preferably of steel wire, they could also be fabricated from other suitable material based on the strength requirements determined by the particular elongated objects to be handled.

The present invention was developed for export log handling and transportation. As with the current practice, bundles of logs 22 are loaded aboard a ship 23 from a dock 24 by utilizing the ship's gear and workers for connecting the various handling means to the logs and then the ship's gear. As with presently utilized loading systems, the bundles of logs 22 are usually held within a bunk comprising a pair of cradles each indicated at 26. The bunk supports the requisite number of logs on dock 24 at a position which is elevated from the actual surface of the dock.

It should be noted here that when exporting logs, for example, from the west coast of the United States to Japan, exporters typically classify the logs in three-length categories namely: long logs, 38–45 feet; medium logs, 30–38 feet; and short logs ranging in length from 18 to 30 feet. When filling a hold of a ship, it will be the usual practice to fill with logs of a particular length range in order to maximize the hold capacity.

Shown as hanging from the standard ships gear indicated generally at 28, is elongated support frame 29. Support frame 29 when designed for handling logs will be on the order of 12–16 feet in length and may be constructed of a steel I-beam. The frame 29 is held at two points and is connected to the ship's gear so as to maintain its horizontal relationship with the ground. Providing a ground support for frame 29 are two triangular shaped legs, each indicated as 30. Of course, it will be appreciated that ship's gear 28 includes the necessary apparatus for raising and lowering frame 29 to a position above a bundle of logs 22 to a position within the hold 31 of the ship 23.

Suspended from beneath frame 29 are pairs of spaced apart releasable hooks 32, 34 and 36, 38 respectively. Each releasable hook has a body portion 40 and a hook portion 42. Body portion 40 is attached adjacent to its opposing releasable hook through any suitable means 44 that allow the hooks to both swivel and pivot for ease of movement. The hooks 32, 34 and 36, 38 are operable from a closed position to a released position automatically on a proper command. In the preferred embodiment, the releasable hooks may be substantially similar to the hook as disclosed in issued U.S. Pat. No. 4,095,833 assigned to Cranston Machinery Company, Inc. of Oak Grove, Oreg. The releasable hook as described in the aforementioned patent which is incorporated herein by this reference is operable through a pneumatic circuit which includes lines 46 and supply tank 48.

For handling and loading and unloading logs, the pairs of spaced apart releasable hooks 32, 34 and 36, 38 should be spaced approximately 13 feet apart. Serving to control in part the activation of hook portions 42, is a radio control means mounted on frame 29 which is comprised of a receiver 52 and antenna 54. The transmitter (not shown) will be operated by either the ship's gear operator or some other individual who observes the position of the log bundles and sends a properly timed signal for releasing the hooks 32, 34 and 36, 38 simultaneously.

With the use of slings 10 in the log handling and transporting application, it has been found that each sling should be approximately 40 feet in length with the eyes 12, 14 being approximately 18 to 24 inches in length. The wire within the sling 10 should have a test capacity of approximately 40 metric tons while the individual releasable hooks should have a capacity of from between 4 to 10 tons. Each of the snap hooks 18 should have a capacity of from 8 to 10 tons. The length of wire slings 10 is selected based on the fact that with shorter logs, more logs will form a bundle and for carrying out the invention, the wire sling length must be greater than the circumference of any particular log bundle. In the embodiment depicted in the drawings particularly FIGS. 4 and 5, it may be noted that the sling length is about 1½ to 2 times the circumference of the log bundle which allows the individual logs to spread when the load is deposited in a ship's hold 31. The pair of slings and the manner in which they are attached to the releasable hooks should allow a capacity for lifting logs of up to 30 metric tons per lift. This translates typically into approximately 8 long logs per load and up to 15 short logs per load.

Figure 6:
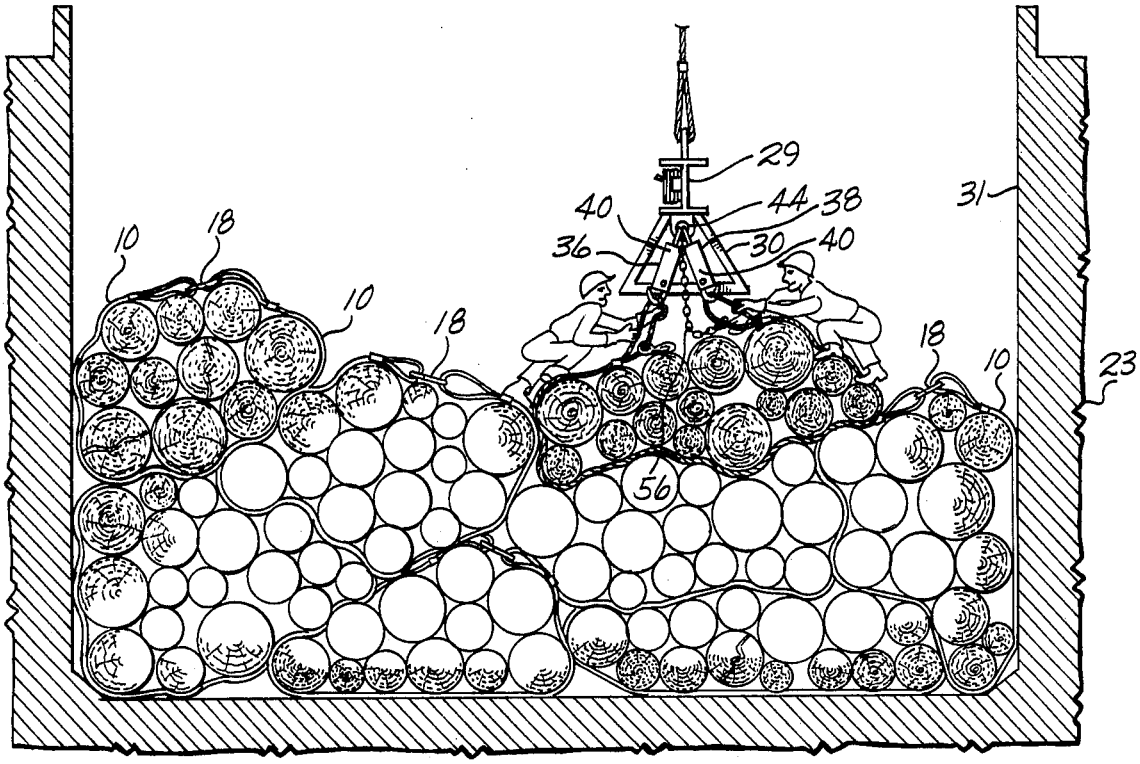
FIG. 6 is also a cross-sectional view through the hold of a ship at the discharge side of a voyage showing the pair of slings being reconnected to the releasable hooks.
Figure 7:
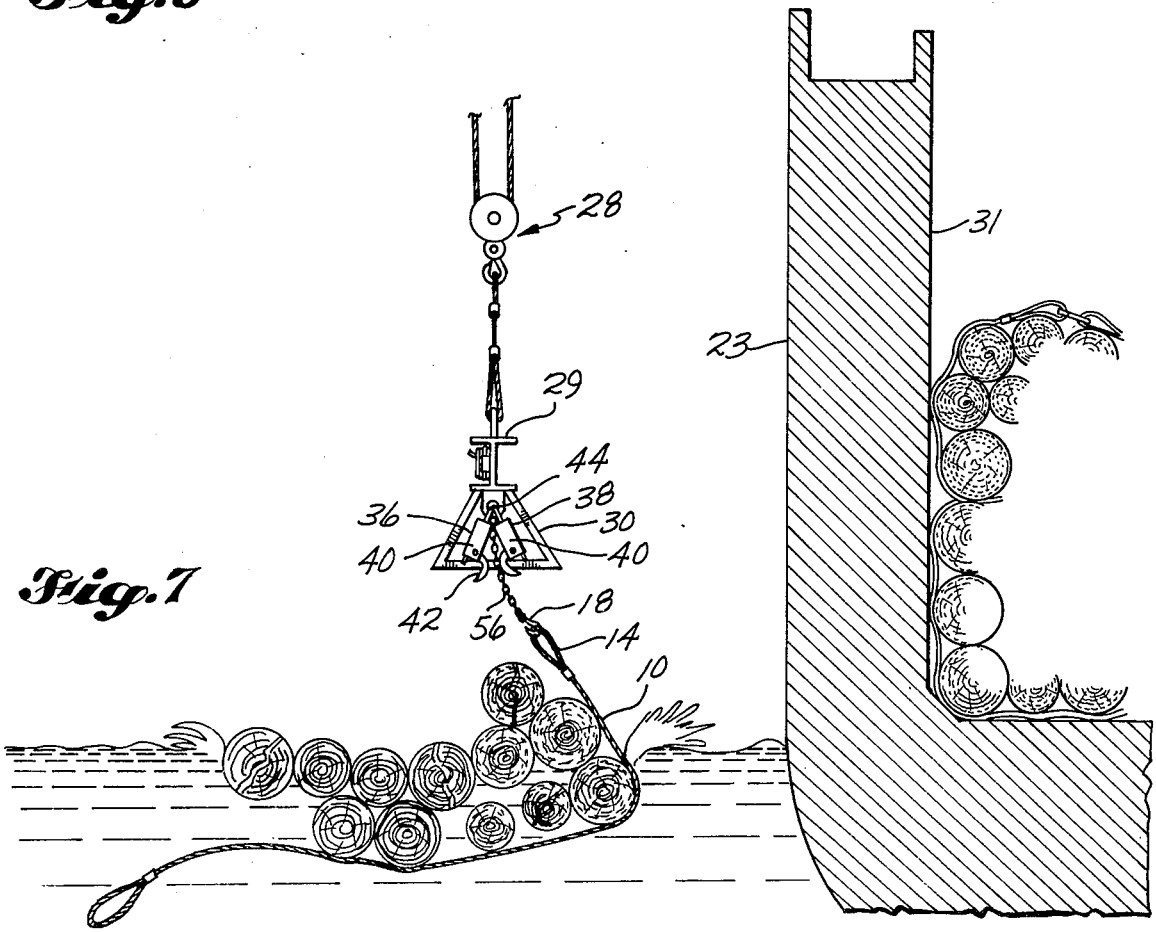
FIG. 7 is also a view at the discharge side of a voyage depicting the overhead frame as it will be when it releases a bundle of logs for a water discharge with the slings being attached to the frame.

Turning now to FIGS. 6 and 7, the figures depict the unloading sequence at the discharge side. Shown depending from the bottom of frame 29 are a pair of loose chains 56. The end of each chain 56 will be adapted to have the snap hook 18 releasably attached to it. As will be apparent when referring to FIG. 7, the purpose of chains 56 is to hold each sling 10 by one eye when the hooks 32, 34 and 36, 38 are released. This feature is particularly necessary for unloading into the water.

OPERATION OF THE INVENTION

Again referring to FIGS. 2–5, the loading operation utilizing the present invention will be described. In FIG. 2 frame 29 is shown as being on the inboard side of cradles 26 with the releasable hooks 32, 34 and 36, 38 in their open positions. At least one pair of slings 10 are positioned on dock 24 underneath and toward the ends of the log load. Additional slings could be placed adjacent the slings depicted since many loads of logs will, of course, be loaded. However, only one pair is shown. The eyes 12, 14 with snap hook 18 are on the outboard side of each load. Each worker depicted picks up the inboard eye 14 and slides it over the hook portion 42 of each inboard releasable hook. The hook is then closed either automatically or manually. Next, the workers afix the other eye to the opposite releasable hook and close it thereby encircling the log bundle with slings 10. Next, each snap hook 18 is joined to the opposing eye thereby making the sling continuous about the bundle of logs.

Figure 5:
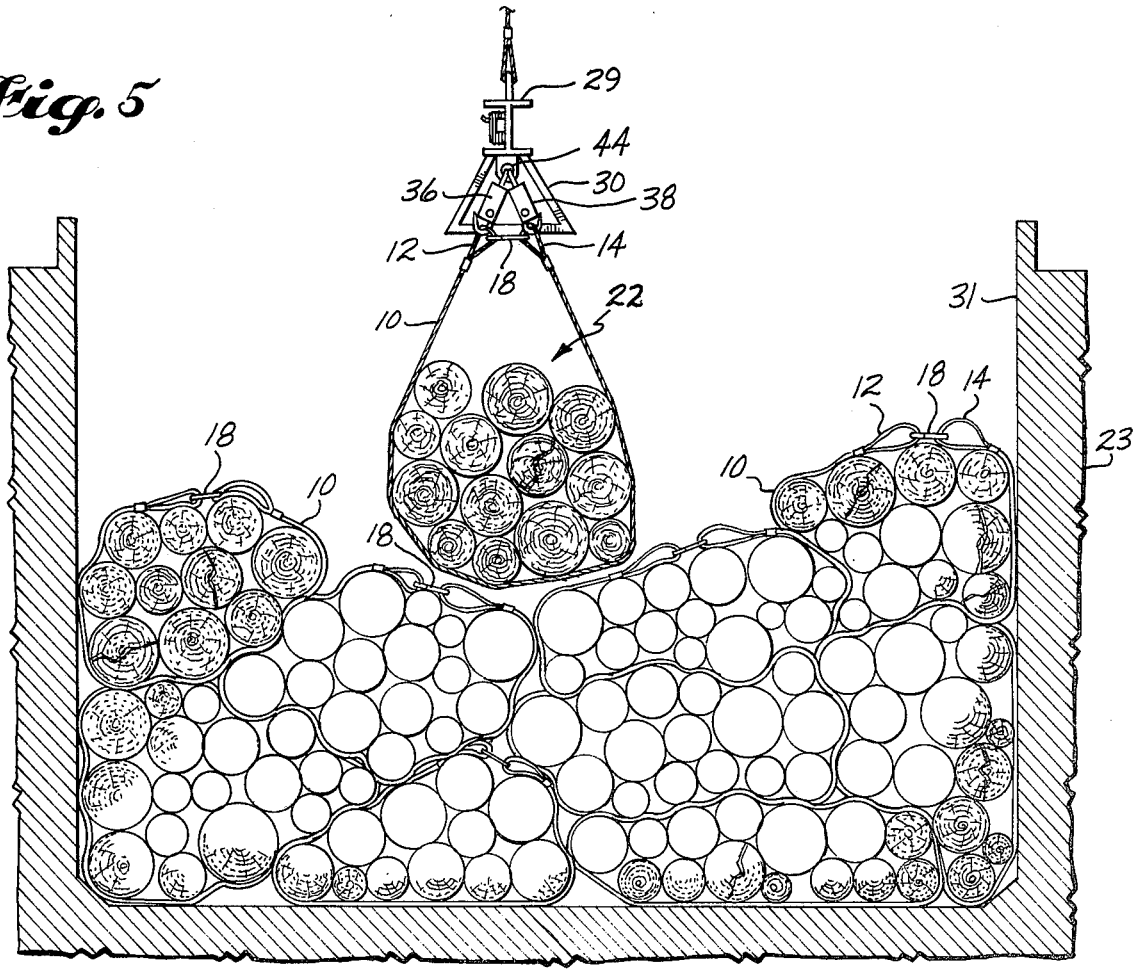
FIG. 5 is a cross-sectional view through the hold of a ship depicting the flexible unitization of the bundles of logs with one bundle about to be released from the frame.

The ship's gear operator then either visually observes the situation or is signaled to begin lifting the load of logs. As frame 29 puts tension on slings 10, the logs will of course shift but eventually they will shift to the condition as depicted in FIGS. 4 and 5. The ship's gear will continue lifting the load of logs and will position them within the hold 31 as depicted in FIG. 5 or on the deck of the ship between outboard stanchions. As the ship's gear lowers the load of logs, the load will be dropped to atop the forming pile and as the tension is released in slings 10, the appropriate person will then send the signal to receiver 52. The signal causes the releasable hooks 32, 34 and 36, 38 to open, dropping the pair of slings 10 with the bundle of logs being allowed to conform to the available space. By having the snap hooks 18 join the two eyes 12, 14 of each sling together, each load of logs will be unitized in a flexible manner. The pair of slings 10 will remain with its bundle of logs and be transported to the discharge point at which point the slings will become part of the unloading system. It should be noted that when the bundle of logs is discharged, little manual labor is required, thereby making the system much safer than when people were required in the hold or on deck.

Turning now to FIGS. 6 and 7, the discharge operation will be described generally. When the ship 23 arrives at its destination, the frame 29 which travels with the ship will be moved by the ship's gear into a position above a bundle of logs where at least one worker must then reattach the sling eyes to the releasable hooks. This operation is depicted in FIG. 6 where two workers are attaching the eyes to the releasable hooks and removing the snap hook from the opposing eye. For water discharge and certain dock discharges, the chains 56 are used by connecting the snap hook to the chain.

The workers move out of the way and signal the operator of the ship's gear to lift the bundle of logs and transport them to the discharge point. On the dock at a typical discharge site, a waiting bunk will receive the bundle of logs being held by the slings. As the ship's gear lowers the bundle and the tension is relieved, a signal will be sent to the receiver 52 to release the hooks and the slings 10 will simply fall onto the dock leaving the logs free in the bunk.

For a water discharge, one of the workers will attach the snap hooks to the chains. Again, the ship's gear operator will lift the load of logs and frame 29 to a position alongside the ship over the water as depicted in FIG. 7. The entire bundle will be lowered into the water thereby relieving tension on the slings at which point the hooks are released, letting the logs float in the water. The slings are held to the frame by the chain connections.

For return to the loading point, the plurality of slings will be stored on board as will the frames and the return voyage made. Periodic inspection of the slings and frames should be made to insure safe operation.

While a detailed description of the preferred embodiment and its operation have been given, it will occur to those skilled in the art that many modifications and refinements may be made. Intended to be included within the scope of the claims are all such modifications.

What is claimed is:

1. An apparatus for handling and transporting loads of elongated objects, comprising:

transport means having space on board for receiving and stowing flexibly unitized loads of elongated objects, at least a pair of slings, each extending about the load of objects and having lengths greater than the peripheral distance about the load and spaced toward the ends of the objects, having eyes in each end and means for releasably connecting the eyes together into a unitary sling, an elongated frame having spaced pairs of releasable grasping means depending downwardly therefrom for sequential attachment and detachment to individual eyes in corresponding slings, and means for lifting the frame with a load of elongated objects resting within the slings and having the grasping means attached to the eyes of the slings.

2. The apparatus as in claim 1 in which the eye grasping means includes pairs of releasable hooks spaced apart on a frame at locations coinciding with where the eyes of the slings will be grasped for handling.

3. The apparatus as in claim 2 in which the releasable hooks are electronically controlled.

4. The apparatus as in claim 1 in which the eyes of each sling in the pair are connected together for loading onto the transport means.

5. The apparatus as in claim 1 in which the eyes of each sling in the pair are disconnected for unloading from the transport means.

6. The apparatus as in claim 5 in which one eye of each sling is releasably connected to the lifting means.

7. A method of handling and transporting loads of elongated objects with slings having eyes in their ends, comprising:

loosely surrounding a load of the elongated objects with at least a pair of the slings spaced toward the ends of the load, releasably connecting the eyes of each sling together to form a pair of continuous slings about the load, thereby establishing a flexible unitized load of elongated objects, connecting each eye in the pairs of eyes in a sling to a separate releasable grasping means, spaced apart pairs of which depend downwardly from an elongated frame, lifting the frame and thereby the unitized load and placing the load in a transport means, releasing the eyes of the slings from the releasable grasping means and allowing the objects to conform to the available space within the confines of the continuous slings, and transporting the unitized loads with the slings in place about the load to a discharge location.

8. The method as in claim 7 including the step of unloading the unitized loads, comprising:

disconnecting the eyes of the slings, connecting the eyes of the slings to a means for lifting the loads, lifting the ununitized loads from the transport means and depositing them outside of the transport means, and removing the slings from the load.

9. The method as in claim 8 including connecting one eye of each sling to the means for lifting loads prior to unloading.

10. The method as in claim 9 in which the load is discharged to water.

11. The method as in claim 8 in which the load is discharged to ground.

* * * * *